US010052907B1

(12) United States Patent
Lyon et al.

(10) Patent No.: US 10,052,907 B1
(45) Date of Patent: Aug. 21, 2018

(54) WRITING INSTRUMENT

(71) Applicants: Kent David Lyon, Cypress, TX (US); Jym Daniel, Austin, TX (US)

(72) Inventors: Kent David Lyon, Cypress, TX (US); Jym Daniel, Austin, TX (US)

( * ) Notice: Subject to any disclaimer, the term of this patent is extended or adjusted under 35 U.S.C. 154(b) by 0 days.

(21) Appl. No.: 15/491,957

(22) Filed: Apr. 19, 2017

(51) Int. Cl.
*B43K 25/02* (2006.01)

(52) U.S. Cl.
CPC ..... *B43K 25/02* (2013.01)

(58) Field of Classification Search
CPC ..... B43K 24/02; B43K 24/08; B43K 25/00; B43K 25/02; B43K 25/024; B43K 25/026
See application file for complete search history.

(56) References Cited

U.S. PATENT DOCUMENTS

| | | | | |
|---|---|---|---|---|
| 1,412,505 | A * | 4/1922 | Carlson | B43K 25/024 24/11 CT |
| 1,950,960 | A * | 3/1934 | Wisser | B43K 29/001 33/27.02 |
| 6,499,196 | B1 * | 12/2002 | Mittersinker | B43K 25/022 24/11 CC |
| 7,044,827 | B1 | 5/2006 | Krull | |
| 7,179,004 | B2 | 2/2007 | Cetera | |
| 9,211,757 | B2 * | 12/2015 | Osborne | B43K 23/001 |
| 2005/0201810 | A1 * | 9/2005 | Zhu | B43K 25/02 401/6 |
| 2006/0233591 | A1 * | 10/2006 | Dietz | B43K 25/026 401/131 |
| 2015/0202544 | A1 | 7/2015 | Snee, Jr. et al. | |

FOREIGN PATENT DOCUMENTS

| | | | | |
|---|---|---|---|---|
| DE | 3724362 | A1 * | 2/1989 | B43K 25/00 |
| DE | 10044334 | A1 * | 4/2002 | B43K 25/00 |
| DE | 102011112551 | * | 3/2013 | B43K 25/026 |

* cited by examiner

*Primary Examiner* — Jennifer C Chiang
*Assistant Examiner* — Bradley Oliver
(74) *Attorney, Agent, or Firm* — Karen B. Tripp

(57) ABSTRACT

A writing instrument has a detachable clip member with a pliable clip rod. A first clip end member is connected to one end of the pliable clip and has a magnet adapted to be magnetically coupled to a barrel of the writing instrument. A second clip end member is connected to the second rod end and is adapted to be removably and operably connected to the one end of the writing instrument. The second clip end member is also adapted to be magnetically coupled to the first clip end member. The detachable clip member can be moved between at least three positions selected from the group consisting of a resting position, a clasping position, a free-end fidgeting position, a closed-end fidgeting position, and a detached fidgeting position.

18 Claims, 6 Drawing Sheets

WRITING INSTRUMENT

FIELD OF THE INVENTION

The present invention relates to the field of writing instruments and, in particular, to a clip for a writing instrument.

BACKGROUND OF THE INVENTION

Many people fidget as a result of nervous energy, stress, agitation, and/or boredom. Others have trouble concentrating and need to move to release energy. Still other studies have shown that fidgeting helps relieve cognitive load by offloading some of the load to movement, thereby freeing up resources to concentrate on a mental process.

Fidgeting is often manifested by playing with one's fingers, hair, jewelry or item of clothing. Alternatively, a person might play with coffee cups, labels on bottles, candy wrappers, paper clips and the like. Still others may click on a retractable pen. These actions may distract others, for example in a classroom or a meeting. However, in many cases, a person who is restrained against fidgeting may not be able to fully concentrate and/or fully absorb what is being said, read or viewed in a particular activity. Many people therefore find they are able to more fully concentrate on a speaker, text they are reading, video they are watching or text they are writing, by fidgeting.

Various efforts have been made for relieving the urge to fidget. As an example, U.S. Pat. No. 7,044,827B1 (Krull) describes a hand-held amusement device having a base that is configured for rocking back and forth on a surface, and components that can be moved by the user relative to the base. These components include a rotatable cylinder, a telescoping plunger, a slideable clip, a pivoting lever, a hole for twirling, text embossed in braille, and a rotatably mounted ball.

Likewise, US2015/0202544A1 (Snee, Jr. et al) discloses a tactile feedback device that is handheld with attachments for replicating a human fidgeting action such as rolling a pencil, clicking a pen, twisting hair and rotating a cylinder.

The Krull and Snee, Jr. et al devices provide outlets for nervous energy or cognitive load. However, the devices are disadvantageous because they may be viewed as unprofessional in a meeting as they have the appearance of a toy, and/or because they may be easily forgotten by a user on his/her way to a meeting, classroom, library, coffee shop and the like.

It would be more convenient and professional to have the device integrated with a tool, such as a writing instrument, that would typically be used at and taken to a meeting, or the like.

There is a need, therefore, for developing a writing instrument that has a component for improving cognitive function. To that end, U.S. Pat. No. 7,179,004B2 (Cetera) relates to a clip that may be attached to a handheld instrument, such as a pen. The clip has a track with parallel rails with a slidable member for a user to slide up and down on the clip rail, for relieving nervous stress. Cetera suggests that an advantage of his device is that the movement of the sliding member on the clip rails replicates the clicking movement of a pen plunger, without making noise or wearing the function of the pen plunger.

U.S. Pat. No. 9,211,757B2 (Osborne) discloses a twirling writing instrument. A gripping member has a shaft that extends in a transverse direction relative to the writing instrument body. A rotary assembly couples the gripping member to the instrument body and allows a user to twirl the instrument body, in a similar fashion to twirling a baton. Osborne contemplates the use of the twirling instrument when a user is contemplating what to write prior to writing, listening to someone or something that may require making notes, and for providing stimulation or amusement when the writing instrument is not being used to actively mark.

While the sliding action of Cetera and the twirling action of Osborne may help people with the fidgeting movement, the devices may not be sufficiently versatile to stimulate a user in need of fidgeting to improve cognitive function, by, for example, improving attention span, relieving cognitive load and/or improving memory, and/or to relieve nervous energy or stress. Moreover, the sliding function of Cetera and the twirling function of Osborne are limited to operation when a user is not actively marking with their writing instrument.

There is a need for a writing instrument that is sufficiently versatile to allow different types of fidgeting movements. There is also a need for a writing instrument that allows a user to either fidget or readily disengage from fidgeting while using the pen. There is also a need for a writing instrument having a fidgeting component that can provide a secondary function.

SUMMARY OF THE INVENTION

According to one aspect of the present invention, there is provided a writing instrument having a marking component for marking a writable surface, comprising: a first instrument end and a second instrument end, the first instrument end adapted to receive a portion of the marking component; a barrel for housing at least a portion of the marking component, the barrel having at least a portion thereof formed of a ferrous material; the barrel positioned between the first instrument end and the second instrument end; a detachable clip member having a pliable clip rod having a first rod end and a second rod end; a first clip end member connected to the first rod end, the first clip end member comprising a magnet adapted to be magnetically coupled to the barrel at the portion of the barrel formed of ferrous material; and a second clip end member connected to the second rod end, the second clip end member adapted to be removably and operably connected to the second instrument end, the second clip end member further adapted to be magnetically coupled to the first clip end member; whereby the detachable clip member is adapted to be moved between at least three positions selected from the group consisting of a resting position, a clasping position, a free-end fidgeting position, a closed-end fidgeting position, and a detached fidgeting position.

BRIEF DESCRIPTION OF THE DRAWINGS

The device of the present invention will be better understood by referring to the following detailed description of preferred embodiments and the drawings referenced therein, in which.

DETAILED DESCRIPTION OF THE INVENTION

The present invention provides a writing instrument that allows a user to practice a number of different fidgeting movements. The writing instrument thereby provides an outlet for relieving nervous energy or stress. In other uses, the writing instrument allows a user to improve cognitive function by off-loading cognitive load to a movement enabling a person to better focus, be more attentive and/or improve memory or attention span. The writing instrument further allows a person to fidget with a component thereof, while still allowing the user to use the writing instrument to mark a writable surface. Moreover, the writing instrument has a fidgeting component that can be used to secure the writing instrument to a purse, backpack, briefcase, laptop or tablet case, a pad or portion of book, a portfolio, a lanyard, or an article of clothing.

Figure 1A:
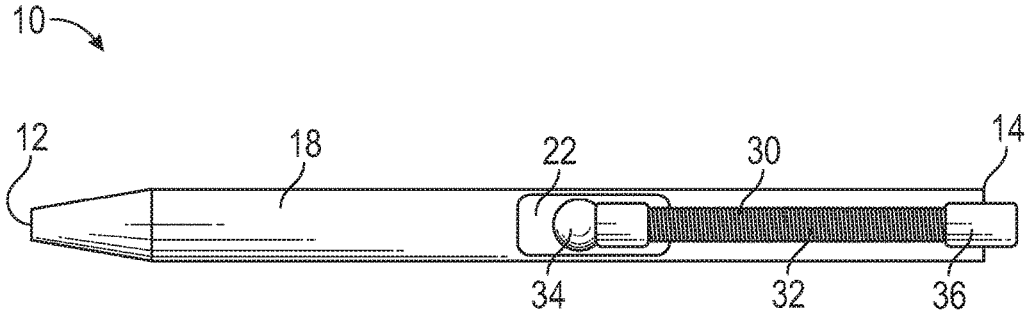
FIG. 1A is a top plan view of one embodiment of the writing instrument of the present invention in a retracted state.
Figure 1B:
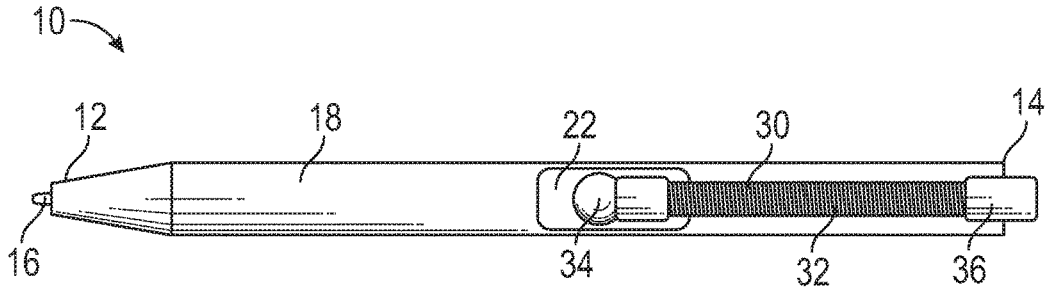
FIG. 1B is a top plan view of the writing instrument of FIG. 1A in an extended state.

Referring now to the drawings, FIGS. 1A and 1B show one embodiment of a writing instrument 10 of the present invention. The writing instrument 10 has a marking component for marking a writable surface. The writing instrument 10 may be an ink pen, a pencil, a stylus, a digital pen, a highlighter, a marker, or a combination thereof. In a preferred embodiment, the writing instrument 10 is retractable. For convenience, the writing instrument 10 depicted in the drawings is a retractable pen. However, it will be understood that the invention may also be applied to a non-retractable writing instrument, including writing instruments with a cap, without departing from the spirit of the present invention.

The writing instrument 10 has a first instrument end 12 and a second instrument end 14. The first instrument end 12 is adapted to receive a portion of the marking component 16. Thus, in FIG. 1B, the writing instrument 10 shows the first instrument end 12 as receiving the tip portion of the marking component 16. Positioned between the first instrument end 12 and the second instrument end 14 is a barrel 18 for housing at least a portion of the marking component 16, for example an ink cartridge (not shown) and the mechanism for operating the writing instrument 10. A variety of mechanisms are available for operating the writing instrument 10, and one embodiment will be discussed in more detail below. However, it will be apparent to those skilled in the art that present invention may be applied to a variety of writing instrument mechanisms without departing from the sprit of the present invention.

The barrel 18 has a portion 22 thereof formed of ferrous material. As discussed in more detail below, other embodiments of the barrel 18 are also possible.

The writing instrument 10 has a detachable clip member 30. The detachable clip member 30 has a pliable clip rod 32 having a first clip end member 34 connected to one end of the clip rod 32 and a second clip end member 36 connected to the other end of the clip rod 32. The pliable clip rod 32 is preferably made with a spring, as depicted in FIG. 1A. However, other configurations and materials are possible, without departing from the spirit of the present invention.

The first clip end member 34 has a magnet so that the first clip end member 34 can be magnetically coupled to the barrel 18, for example, at the portion 22 that is formed of ferrous material. In the embodiments discussed below, the first clip end member 34 may be coupled to other parts of the barrel 18, with the clip rod 32 in a substantially straight configuration or a bent configuration. Preferably, the first clip end member 34 has a spherical shape. This preferred embodiment allows for a number of fidgeting movements, as will be discussed in more detail below.

The second clip end member 36 is adapted to be removably and operably connected to the second instrument end 14. The operable connection between the second clip end member 36 and the second instrument end 14 may be mechanical, such as a press fit, a snap fit, a threaded engagement, or the like, magnetic or a combination thereof. Preferably, the connection between the second clip end member 36 and the second instrument end 14 is magnetic, wherein at least one of the second instrument end 14 and the second clip end member 36 has a magnetic component. More preferably, both the second instrument end 14 and the second clip end member 36 have a magnetic component.

Figure 2A:
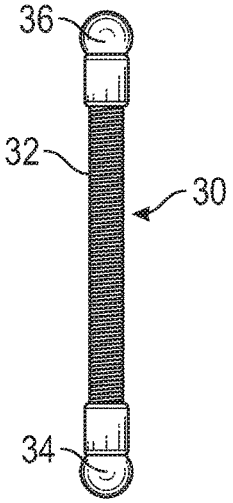
FIGS. 2A-2C are side elevation views of three embodiments of a detachable clip member for the writing instrument of the present invention.
Figure 2B:
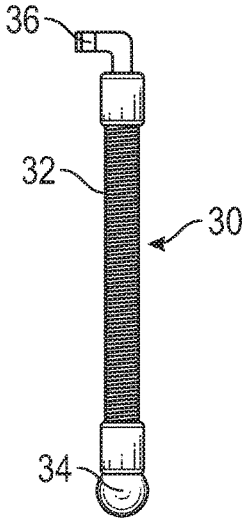
Figure 2C:
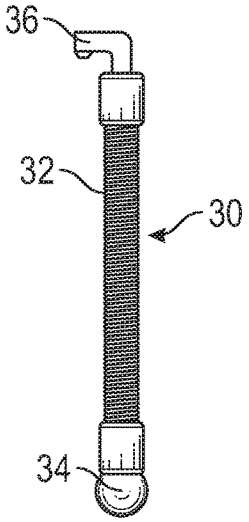

The second clip end member 36 is also adapted to be magnetically coupled to the first clip end member 34. The second clip end member 36 may include a magnet or be formed of a ferrous material for coupling to a magnetic component. Preferably, the second clip end member 36 has a spherical shape, as shown in FIG. 2A. However, the second clip end member 36 may have a collar for connecting to the second instrument end 14, as shown in FIG. 2B or the second clip end member 36 may have a protrusion, as shown in FIG. 2C, for mating with a corresponding depression in the second instrument end 14. It will be understood by those skilled in the art that other configurations of the second clip end member 36 are possible without departing from the spirit of the present invention.

Figure 3:
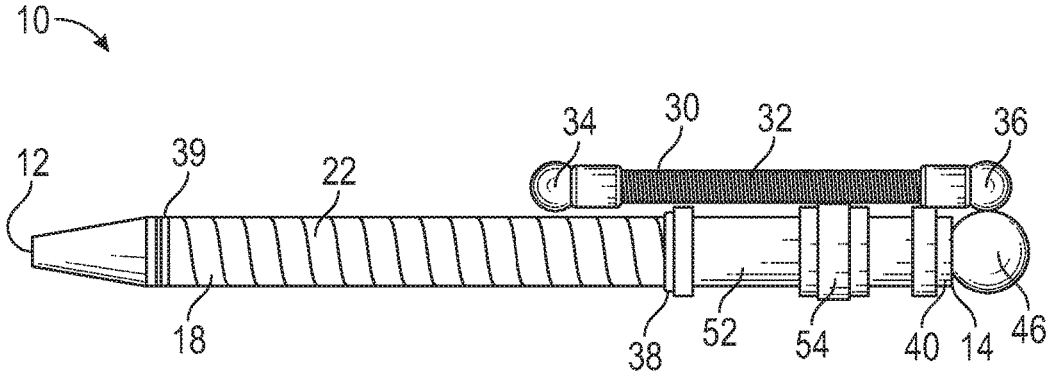
FIG. 3 is a side elevation view of another embodiment of the writing instrument of the present invention.
Figure 4:
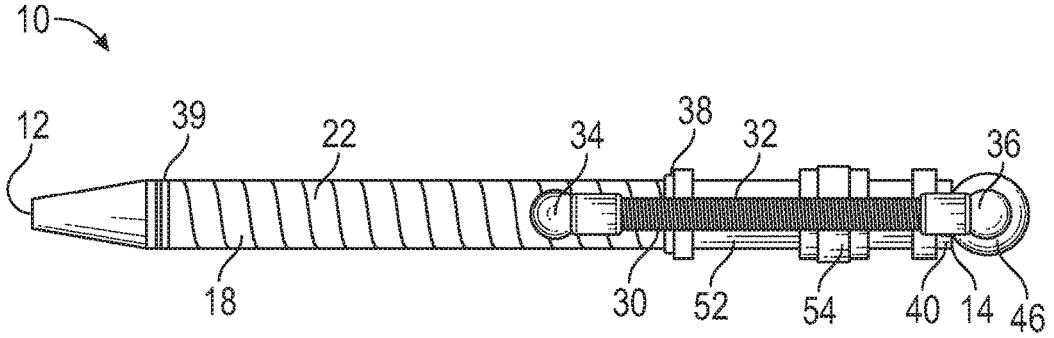
FIG. 4 is a top plan view of the writing instrument of FIG. 3.
Figure 5A:
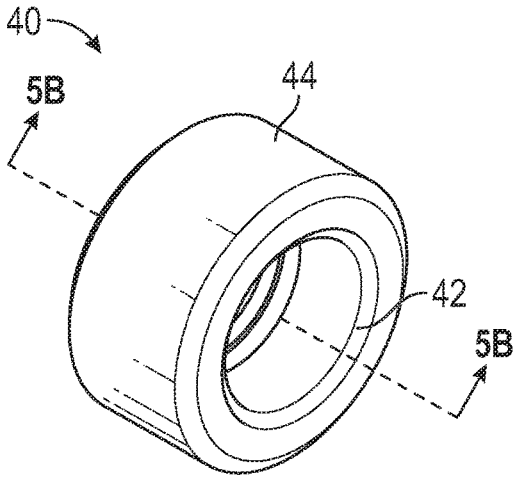
FIG. 5A is a perspective view of a magnetic collar of the FIG. 3 embodiment of the writing instrument of the present invention.
Figure 5B:
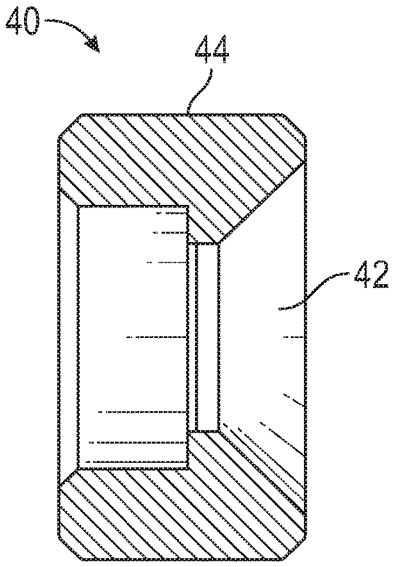
FIG. 5B is a side cross-sectional view of the magnetic collar of FIG. 5A.

A preferred embodiment of the writing instrument 10 of the present invention is illustrated in FIGS. 3 and 4. In this embodiment, the second instrument end 14 has a magnetic collar 40, shown more clearly in FIGS. 5A and 5B. The magnetic collar 40 has an inner countersunk well 42 and an outer wall 44. The inner countersunk well 42 can be used for receiving the second clip end member 36, which is preferably a sphere as shown in the embodiment shown in FIGS. 3 and 4. Alternatively, in a more preferred embodiment, the countersunk well 42 can receive a ferrous end sphere 46, which can serve as an intermediary connector for magnetically coupling the second clip end member 36 to the second instrument end 14.

In a preferred embodiment, as illustrated in FIGS. 3 and 4, at least a portion of the barrel 18 is a formed of a pliable material that has sufficient resiliency to allow a user to efficiently use the writing instrument 10 of the present invention to mark a writable surface, while still providing a pliable section for fidgeting. Suitable pliable materials include a round spring formed of a metal having a round cross-section, a rectangular spring formed of a metal having a rectangular cross-section, a braided material, a woven material, and combinations thereof. A more preferred pliable material is a rectangular spring formed of a metal having a rectangular cross-section, as illustrated in FIGS. 3 and 4. The pliable material is preferably formed of a ferrous material. Preferably, the portion of the barrel 18 formed of pliable material is supported by shoulders 38 and 39.

Also, in a preferred embodiment, the barrel 18 also comprises a slider portion 52 proximate the second instrument end 14. The slider portion 52 is preferably formed of a non-ferrous material, such as aluminum or plastic.

In a more preferred embodiment, the operation of the writing instrument 10 is performed using an internal magnetic retracting mechanism. The internal magnetic retracting mechanism may be as simple as an internal magnet connected to one end of a marking component 16. The marking component 16 is extended and retracted by causing an internal magnet 62 to push the marking component 16 to and from an extended position by sliding a slidable magnetic ring 54 along the slider portion 52, for example between slider stops 56, 58. One or both of the slider stops 56, 58 may be magnetic. Preferably, the slidable magnetic ring 54 is formed of a first magnetic ring 54*a*, a middle ferrous ring 54*b* and a second magnetic ring 54*c*.

Figure 6:
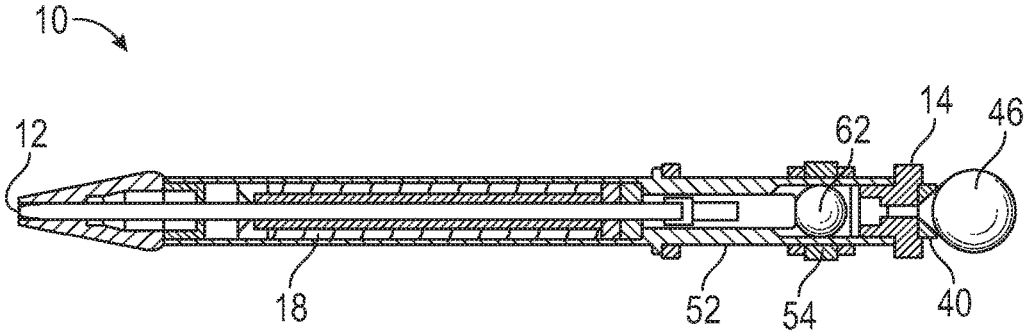
FIG. 6 is a simplified cross-sectional view of the FIG. 3 embodiment, without the detachable clip.
Figure 7:
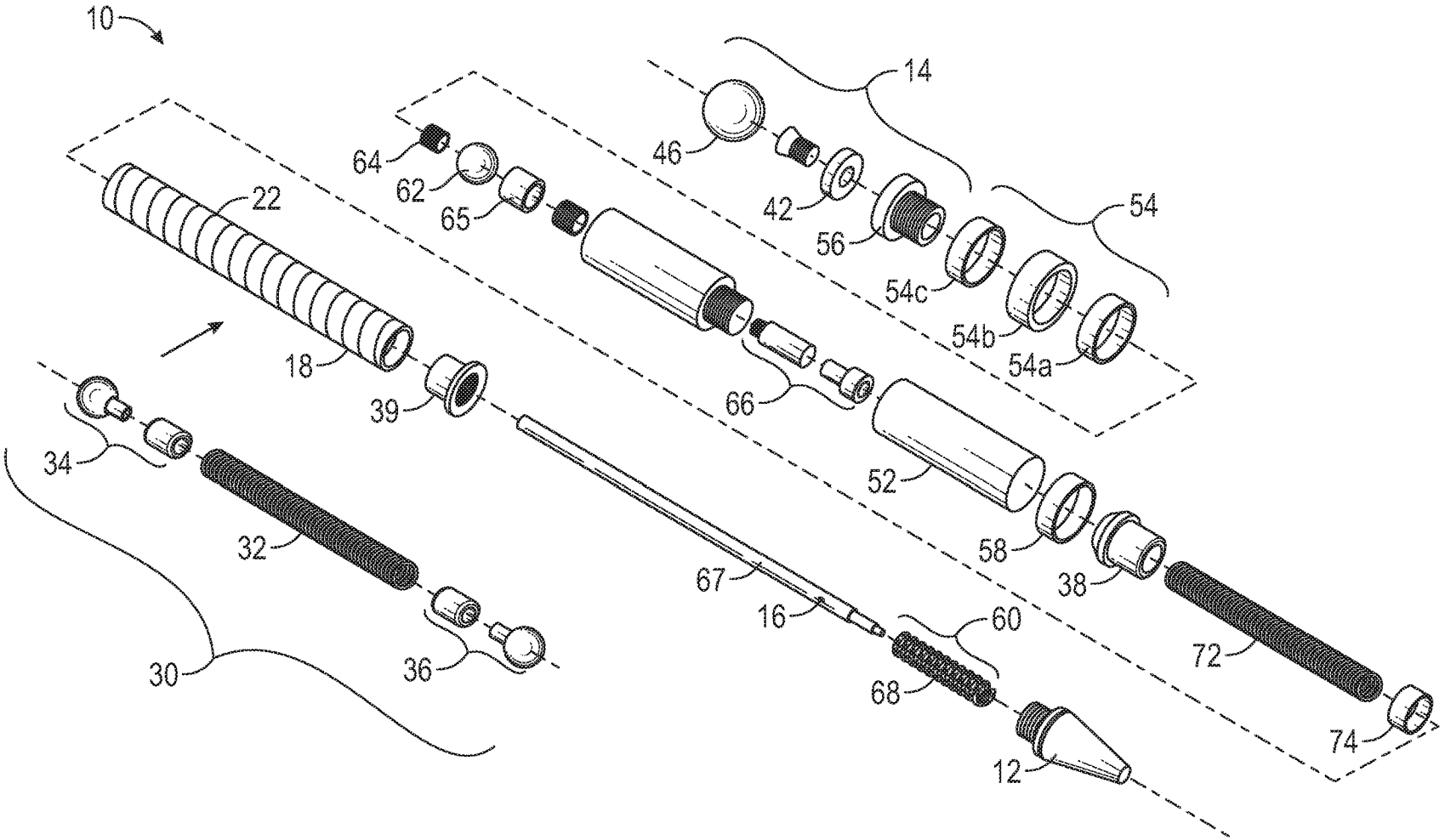
FIG. 7 is an exploded perspective view of the FIG. 3 embodiment of the writing instrument of the present invention.
Figure 8:
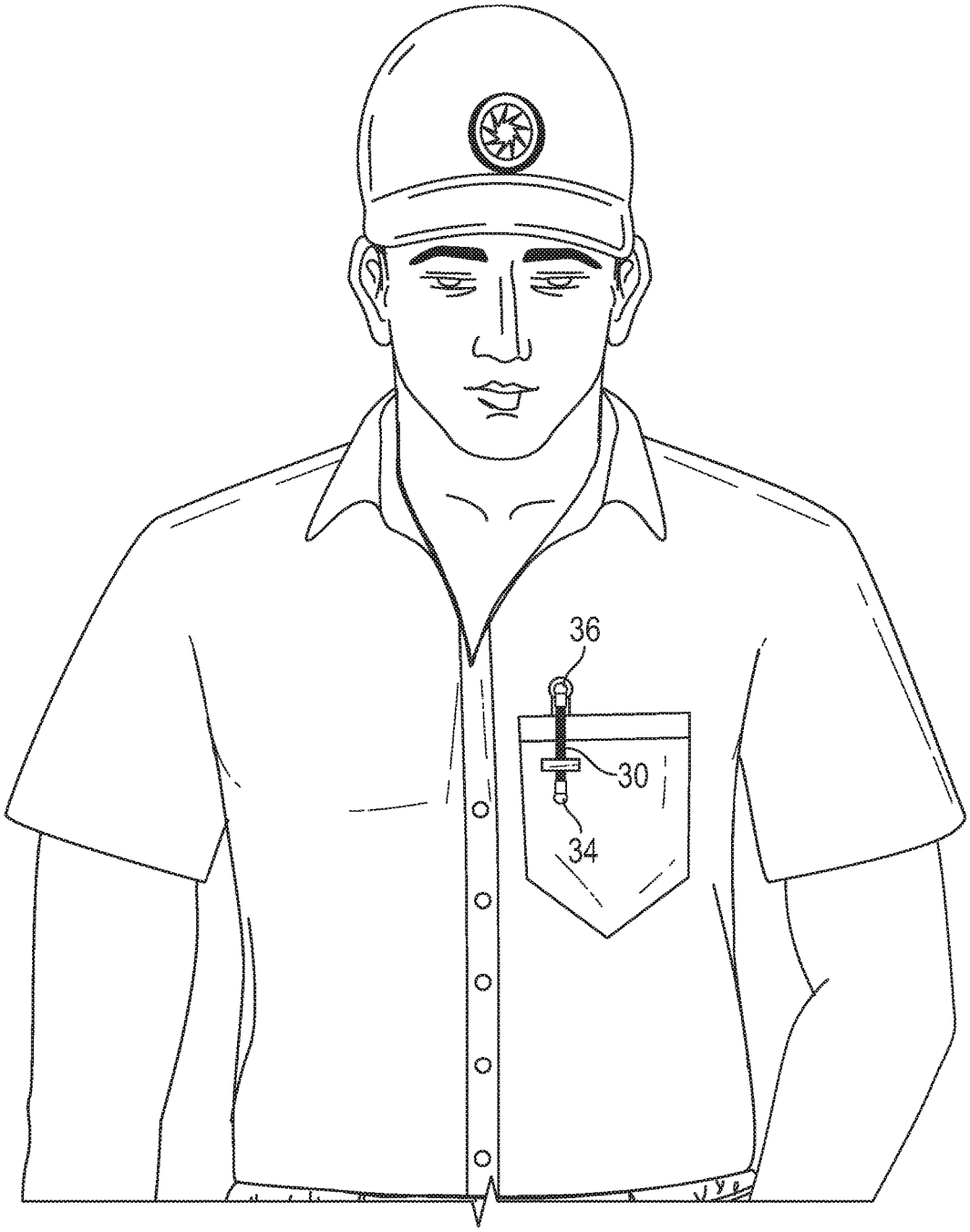
FIG. 8 is a partial front view of the FIG. 3 embodiment of the writing instrument of the present invention shown in use, in an example clasping position.
Figure 9:
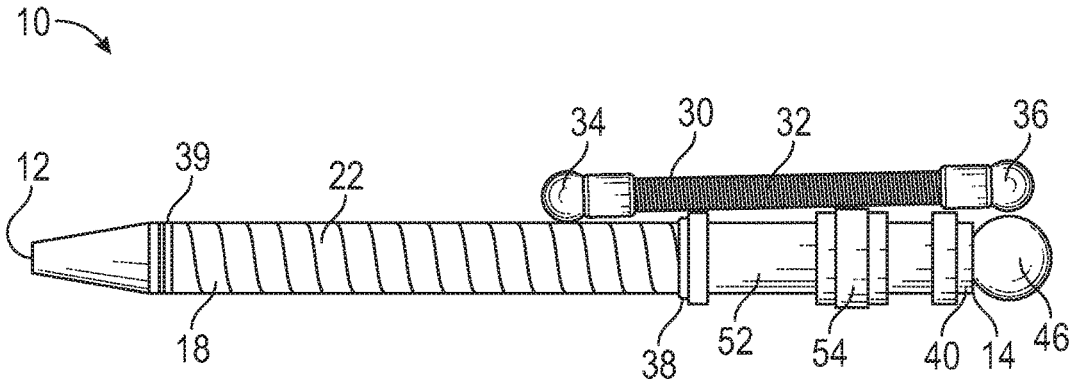
FIG. 9 is another side elevation view of the FIG. 3 embodiment, shown in an example free-end fidgeting position.
Figure 10:
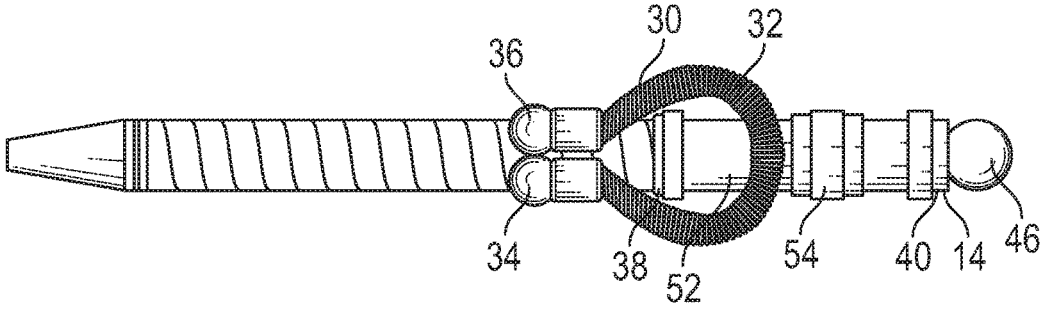
FIG. 10 is another top plan view of the FIG. 3 embodiment, shown in an example closed end fidgeting position.

An especially preferred mechanism is disclosed in our copending application, filed concurrently herewith. The mechanism is illustrated in the embodiment shown in FIGS. 6 and 7. Moving the slidable magnetic ring 54 along the slider portion 52 pushes a clicker cap 65 of a clicker cam assembly, which cooperates with cartridge shoulders 67 and spring 68 to extend and retract the marking component 16. The clicker cam assembly illustrated in FIG. 7 has a pair of coacting cam members 66, a clicker cap 65, and a clicker spring 63 for operably engaging the clicker cap 65 and the pair of coacting cam members 66. A spring 64 is provided to urge the internal magnet 62 against the clicker cam assembly for operably engaging the clicker cam assembly. It will be understood by those skilled in the art that other types of the clicker cam assembly are possible without departing from the spirit of the present invention.

When the barrel 18 includes a pliable portion, advantageously, a cartridge spring 72 is provided for receiving the writing component 16, which is centered in the barrel 18 with centering collar 74.

In use, the detachable clip member 30 can be moved between at least three positions including, without limitation, a resting position, a clasping position, a free-end fidgeting position, a closed-end fidgeting position, and a detached fidgeting position.

The detachable clip member 30 is in a first resting position when the first clip end member 34 is magnetically coupled to the barrel 18, the second clip end member 36 is connected to the second instrument end 14, and the pliable clip rod 32 is substantially straight. The detachable clip member 30 is in a second resting position when the first clip end member 34 is magnetically coupled to the barrel 18, the second clip end member 36 is connected to the second instrument end 14, and the pliable clip rod 32 is bent. And a third resting position for the detachable clip member 30 has the first clip end member 34 magnetically coupled to the slidable magnetic ring 54 and the second clip end member 36 connected to the second instrument end 14.

The detachable clip member 30 is in a first clasping position around a strap, a loop, a sleeve or the like, and the first clip end member 34 is magnetically coupled to the barrel 18 and the second clip end member 36 is connected to the second instrument end 14. The detachable clip member 30 is in a second clasping position around a strap, a loop, a sleeve or the like, and the first clip end member 34 is magnetically coupled to the second clip end member 36 and the second clip end member 36 is connected to the second instrument end 14.

Advantageously, the detachable clip member 30 is able to accommodate clasping around a variety of page thicknesses, for example 1 page or 20 pages or more, for example as a bookmark, providing more flexibility than a standard pen clip.

The detachable clip member 30 is in a first free-end fidgeting position wherein the first clip end member 34 is magnetically coupled to the barrel 18 and the second clip end member 36 is disconnected from the second instrument end 14. The detachable clip member 30 is in a second free-end fidgeting position wherein the first clip end member 34 is magnetically decoupled from the barrel 18 and the second clip end member 36 is connected to the second instrument end 14. The detachable clip member 30 is in a third free-end fidgeting position wherein the first clip end member 34 is magnetically coupled to the slidable magnetic ring 54 and the second clip end member 36 is disconnected from the second instrument end 14.

The detachable clip member 30 is in a first closed-end fidgeting position wherein the first clip end member 34 is magnetically coupled to the barrel 18 and the second clip end member 36 is magnetically coupled to the first clip end member 34. The detachable clip member 30 is in a second closed-end fidgeting position wherein the first clip end member 34 is magnetically coupled to the second clip end member 36 and the second clip end member 36 is connected to the second instrument end 14.

The detachable clip member 30 is in a detached fidgeting position wherein the first clip end member 34 is magnetically decoupled from the barrel 18 and the second clip end member 34 is disconnected from the second instrument end 14, with or without the end sphere 46.

The magnetically connectable end sphere 46 is movable within the inner countersunk well by rotated between a thumb and forefinger, as an example. The magnetically connectable end sphere 46 is also movable from a first position on the inner countersunk well 42 and a second position on the outer wall 44 of the collar 40.

And, when the barrel 18 is comprised of a pliable material, the writing instrument 10 can be moved from a bent position to a straight position, in a motion similar to breaking a twig between two hands or by pressing counteracting forces between a thumb and fingers of one hand.

While preferred embodiments of the present disclosure have been described, it should be understood that various changes, adaptations and modifications can be made therein without departing from the spirit of the invention(s) as claimed below.

We claim:

1. A writing instrument having a marking component for marking a writable surface, comprising:

a first instrument end and a second instrument end, the first instrument end adapted to receive a portion of the marking component;

a barrel for housing at least a portion of the marking component, the barrel having at least a portion thereof formed of a ferrous material; the barrel positioned between the first instrument end and the second instrument end;

a detachable clip member having a pliable clip rod having a first rod end and a second rod end;

a first clip end member connected to the first rod end, the first clip end member comprising a magnet adapted to be magnetically coupled to the barrel at the portion of the barrel formed of ferrous material; and a second clip end member connected to the second rod end, the second clip end member adapted to be removably and operably connected to the second instrument end, the second clip end member further adapted to be magnetically coupled to the first clip end member;

whereby the detachable clip member is adapted to be moved between at least three positions selected from the group consisting of a resting position, a clasping position, a free-end fidgeting position, a closed-end fidgeting position, and a detached fidgeting position.

2. The writing instrument according to claim 1, wherein the pliable clip rod is formed of a spring.

3. The writing instrument according to claim 1, wherein the second clip end member comprises a magnet.

4. The writing instrument according to claim 3, wherein the second instrument end has at least a portion thereof formed of a ferrous material and second clip end member is adapted to be magnetically coupled to the second clip end member.

5. The writing instrument according to claim 4, wherein the second instrument end comprises a magnetic collar, the collar having an outer wall and an inner countersunk well.

6. The writing instrument according to claim 5, wherein the second instrument end further comprises a magnetically connectable sphere.

7. The writing instrument according to claim 6, wherein the magnetically connectable sphere is movable within the inner countersunk well.

8. The writing instrument according to claim 6, wherein the magnetically connectable sphere is movable from a first position on the inner countersunk well and a second position on the outer wall of the collar.

9. The writing instrument according to claim 1, wherein at least a portion of the barrel is comprised of a pliable material whereby the writing instrument can be moved from a bent position to a straight position.

10. The writing instrument according to claim 9, wherein the pliable material is selected from the group consisting of a round spring formed of a metal having a round cross-section, a rectangular spring formed of a metal having a rectangular cross-section, a braided material, a woven material, and combinations thereof.

11. The writing instrument according to claim 1, wherein the barrel further comprises a slider portion proximate the second instrument end.

12. The writing instrument according to claim 11, wherein the slider portion is formed of a non-ferrous material.

13. The writing instrument according to claim 12, further comprising:

an internal magnetic retracting mechanism for extending and retracting a portion of the marking component through the first instrument end; and a slidable magnetic ring having an inner diameter for receiving the slider portion.

14. The writing instrument according to claim 13, wherein the slidable magnetic ring comprises a first magnetic ring, a middle ferrous ring, and a second magnetic ring.

15. The writing instrument according to claim 1, wherein the writing instrument is selected from the group consisting of an ink pen, a pencil, a stylus, a digital pen, a highlighter, a marker, and combinations thereof.

16. The writing instrument according to claim 1, wherein the marking component is retractable.

17. The writing instrument according to claim 1, wherein the detachable clip member is in a first resting position when the first clip end member is magnetically coupled to the barrel, the second clip end member is connected to the second instrument end, and the pliable clip rod is substantially straight;

the detachable clip member is in a second resting position when the first clip end member is magnetically coupled to the barrel, the second clip end member is connected to the second instrument end, and the pliable clip rod is bent;

the detachable clip member is in a first clasping position around a strap, a loop, a sleeve or the like, and the first clip end member is magnetically coupled to the barrel and the second clip end member is connected to the second instrument end;

the detachable clip member is in a second clasping position around a strap, a loop, a sleeve or the like, and the first clip end member is magnetically coupled to the second clip end member and the second clip end member is connected to the second instrument end;

the detachable clip member is in a first free-end fidgeting position wherein the first clip end member is magnetically coupled to the barrel and the second clip end member is disconnected from the second instrument end;

the detachable clip member is in a second free-end fidgeting position wherein the first clip end member is magnetically decoupled from the barrel and the second clip end member is connected to the second instrument end;

the detachable clip member is in a first closed-end fidgeting position wherein the first clip end member is magnetically coupled to the barrel and the second clip end member is magnetically coupled to the first clip end member;

the detachable clip member is in a second closed-end fidgeting position wherein the first clip end member is magnetically coupled to the second clip end member and the second clip end member is connected to the second instrument end; and the detachable clip member is in a detached fidgeting position wherein the first clip end member is magnetically decoupled from the barrel and the second clip end member is disconnected from the second instrument end.

18. The writing instrument of claim 13, wherein the detachable clip member is in a third resting position when the first clip end member is magnetically coupled to the slidable magnetic ring and the second clip end member is connected to the second instrument end; and the detachable clip member is in a third free-end fidgeting position wherein the first clip end member is magnetically coupled to the slidable magnetic ring and the second clip end member is disconnected from the second instrument end.

* * * * *